United States Patent [19]

Hollyday, Jr.

[11] 3,982,909

[45] Sept. 28, 1976

[54] NITROGEN-CONTAINING COLD FLOW IMPROVERS FOR MIDDLE DISTILLATES

[75] Inventor: William C. Hollyday, Jr., Watchung, N.J.

[73] Assignee: Exxon Research & Engineering Co., Linden, N.J.

[22] Filed: Feb. 13, 1975

[21] Appl. No.: 549,753

[52] U.S. Cl. ..... 44/66; 44/71

[51] Int. Cl.[2] ..... C10L 1/22

[58] Field of Search ..... 44/66, 62, 71

[56] References Cited

UNITED STATES PATENTS

| | | | |
|---|---|---|---|
| 3,166,387 | 1/1965 | Ebner | 44/66 |
| 3,447,916 | 6/1969 | Edwards | 44/71 |
| 3,544,467 | 12/1970 | Kautsky | 44/71 |
| 3,640,691 | 2/1972 | Ilnychyj et al. | 44/66 |
| 3,658,493 | 4/1972 | Hollyday, Jr. | 44/71 |
| 3,672,854 | 6/1972 | Rosenwald et al. | 44/66 |
| 3,681,038 | 8/1972 | Gaydasch | 44/71 |
| 3,846,481 | 11/1974 | Gaydasch | 44/71 |
| 3,883,318 | 5/1975 | Feldman et al. | 44/66 |

*Primary Examiner*—Daniel E. Wyman
*Assistant Examiner*—Y. Harris-Smith
*Attorney, Agent, or Firm*—Roland A. Dexter; Frank T. Johmann

[57] ABSTRACT

Nitrogen compounds such as amides, diamides, and ammonium salts of: monoamides or monoesters of dibasic acids, alone or in combination, with: (a) a hydrocarbon selected from the group of petrolatums, microcrystalline wax, aromatics alkylated with $C_{12}$ to $C_{40}$ alkyl groups and isomerized waxes, and/or (b) a pour point depressant, particularly an ethylene backbone polymeric pour point depressant, are wax crystal modifiers and cold flow improvers for middle distillate fuel oils, particularly diesel fuel.

14 Claims, No Drawings

NITROGEN-CONTAINING COLD FLOW IMPROVERS FOR MIDDLE DISTILLATES

BACKGROUND AND FIELD OF THE INVENTION

U.S. Pat. No. 3,658,493 relates that various nitrogen materials of limited solubility in fuel oil, having at least one straight chain hydrocarbon segment of at least 6 carbon atoms, such as amides and ammonia or amine salts, are wax crystal modifiers for distillate fuel oil and can be used with various ethylene backbone polymeric pour point depressants. In one form, the present invention is based on the discovery that various nitrogen materials, including some of those of the aforementioned patent, are very effective cold flow improvers for middle distillate fuel oils when used with certain hydrocarbon materials, particularly waxy hydrocarbon materials such as petrolatums, microcrystalline waxes, wax alkylated naphthalene, or isomerized wax produced by the Friedel-Crafts isomerization of normal paraffin waxes, which materials may still be used in combination with an ethylene backbone pour point depressant or another pour depressant. In another form of the present invention, various nitrogen-containing materials outside the scope of said U.S. Pat. No. 3,658,493 have been found very effective for enhancing the effectiveness of ethylene backbone pour point depressants.

DESCRIPTION OF THE PRIOR ART (a) Ethylene Backbone Pour Point Depressant

Various pour point depressants have been described in the patent literature. The more effective of these distillate oil pour depressants are copolymers of ethylene with various other monomers, e.g. copolymers of ethylene and vinyl esters of lower fatty acids such as vinyl acetate (U.S. Pat. No. 3,408,479); copolymers of ethylene and alkyl acrylate (Canadian Pat. No. 676,875); terpolymers of ethylene with vinyl esters and alkyl fumarates (U.S. Pat. No. 3,304,261 and 3,341,309); polymers of ethylene with other lower olefins, or homopolymers of ethylene (British Pat. Nos. 848,777 and 993,744); chlorinated polyethylene (Belgium Pat. No. 707,371 and U.S. Pat. No. 3,337,313; etc.)

(b) Waxy Hydrocarbon Materials

The use of petrolatum or microcrystalline wax with a fuel is taught by U.S. Pat. Nos. 3,250,599 and 3,288,527.

(c) Nitrogen Materials

Various nitrogen materials have been described as additives for heating oils in U.S. Pat. Nos. 3,047,102; 3,407,204; 3,677,724; and 3,777,725; as well as the aforesaid U.S. Pat. No. 3,658,493.

U.S. Pat. Nos. 3,444,082 and 3,544,467 describe a class of nitrogen compounds as pour point depressants for waxy hydrocarbonaceous fuels and oils. The class are the C-(n-aliphatic hydrocarbyl) succinamic acids having 2 aliphatic hydrocarbon substituents on the nitrogen and/or the amine salt of said succinamic acid. The aliphatic hydrocarbyl group has at least 14 carbon atoms. The hydrocarbyl substituted succinamic acids are prepared by first isomerizing cracked wax olefins to internal unsaturation which is then followed by adduction of the isomerized olefin and maleic anhydride.

U.S. Pat. No. 3,681,038 discloses N,N-dialkyl rincinoleamide as a pour depressant for middle distillate fuels wherein at least one alkyl group contains from 12 to 26 carbon atoms.

BRIEF SUMMARY OF THE INVENTION

The present invention differs primarily from the aforesaid prior art, in not only finding that certain nitrogen compounds are useful as wax crystal modifiers, but also that they are particularly effective in combination with waxy additives and/or ethylene backbone pour depressants.

These certain nitrogen compounds which include amides, diamides, ammonium salts of monoamides or monoesters of dibasic acids, are characterized by the nitrogen group or groups being structurally isolated from the divalent organo group joining the carbonyl groups. These nitrogen compounds are of a herein defined class consisting of salts of monoamido and monoester derivatives of dicarboxylic acids, esteramides of dicarboxylic acids and N,N dialkyl n-alkanoamides.

Kerosene, which acts as a solvent for n-paraffin wax, had traditionally been a component of middle distillate fuel oils, e.g. diesel fuels and house heating oils. With the demands for kerosene for use in jet fuels, the amount of kerosene used in middle distillate fuel oils has decreased over the years. This, in turn, has frequently required the addition of wax crystal modifiers, e.g. pour point depressant additives, to the fuel oil to make up the lack of kerosene. The ethylene backbone pour point depressants, while very effective in lowering the pour point of distillate oil, sometimes result in wax crystals having large particle sizes. These large particles tend to be filtered out by the screens and other filter equipment normally used on delivery trucks and fuel oil storage systems, with a resulting plugging of these screens and filters even though the temperature of the oil is substantially above its pour point. In the prior patent U.S. Pat. No. 3,658,493, it was found that certain classes of amides, and ammonium and amine salts, result in small particle size crystals which are usually sufficiently small to pass through the screens and filter equipment so as not to cause plugging, and at the same time do not unduly interfere with the action of the pour point depressant in preventing the oil from freezing. The present invention is based on the further discovery that the combination of a N-containing compound of a defined class with certain waxy hydrocarbons and/or ethylene backbone pour depressants can be even more effective in regulating the wax crystal size.

Because of their effectiveness in regulating wax crystal size, the nitrogen-containing additives of the invention are particularly useful in diesel fuels in view of the current tendency and desire to increase the cloud point of diesel fuels by raising the maximum distillation point. One advantage of increasing the cloud point is that the fuel will then contain a larger proportion of higher molecular weight hydrocarbons, which in turn, increases the BTU value of the fuel. The greater BTU value gives operating economies during the operation of diesel engines, for example, diesel trucks. Diesel fuels conventionally have pour points on the order of −30°C. However, by increasing the cloud point, the diesel fuels will have pour points on the order of −12° or −15°C. This higher pour point, in turn, brings about the requirement for reduction of pour point which can be accomplished by the addition of wax crystal modifying additives of the invention. But in addition to pour point, the crystal size must be controlled. Thus, in the normal operation of diesel trucks, the engine is provided with a fine mesh screen, usually about 60 mesh, as a filter ahead of the engine. In cold weather with diesel fuels having pour points of −12° to −15°C., it becomes especially essential that the wax crystals that form are sufficiently fine so that they will pass through the screen and not plug the screen and cut off the fuel from the engine. As previously indicated, the present invention provides an addititive mixture which can be used to regulate the wax crystal to thereby obtain improved cold flow properties in these diesel fuels as well as improving distillate heating oils such as No. 2 fuel oil.

THE NITROGEN COMPOUNDS

The nitrogen compounds of this invention are: salts of monoamide and monoester derivatives of dicarboxylic acids; ester-amides of dicarboxylic and N,N-dialkyl n-alkane amides; and are covered by the general formula -

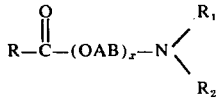

atoms or monovalent organo groups; R is a member of the class consisting of: a $C_1$ to $C_{30}$ alkyl group, a carboxyl derivative of a bivalent $C_1$ to $C_{10}$ hydrocarbyl group, an ester of said carboxyl derivative, an amide of said carboxyl derivative, a salt of said carboxyl derivative and mixtures thereof; and, $R_1$ and $R_2$ are $C_8$ to $C_{24}$, e.g. $C_{10}$ to $C_{24}$, preferably $C_{14}$ to $C_{18}$ straight chain aliphatic groups.

The above formula covers carboxylic acid derivatives which can be esterified and/or amidated and/or converted to a salt. Examples of carboxylic acids used to prepare these materials include $C_4$ to $C_{10}$, e.g. $C_4$, unsaturated aliphatic hydrocarbyl dicarboxylic acid, such as: maleic, fumaric, succinic, succinic anhydride, adipic, glutaric, sebacic, malonic, derivatives and mixtures of the foregoing, etc.

Amines used to prepare the amides include secondary amines of $C_8$ to $C_{30}$ carbon atoms, preferably 10 to 24 carbon atoms.

Amine mixtures may also be used and many amines derived from natural materials are mixtures. Thus, coco amine derived from coconut oil is a mixture of primary amines with straight chain alkyl groups ranging from $C_8$ to $C_{18}$. Another example is tallow amine, derived from hydrogenated tallow, which amine is a mixture of $C_{14}$ to $C_{18}$ straight chain alkyl groups.

To prepare the ester derivatives, preferably $C_{14}$ to $C_{36}$, e.g. $C_{18}$, saturated or unsaturated aliphatic, hydrocarbyl alcohols can be used, including cracked wax Oxo-alcohols, and aldol derived alcohols. Specific examples of these alcohols include 1-tetadeconal, 1-hexadecanol, 1-octadecanol, $C_{12}$ to $C_{18}$ Oxo alcohols made from a mixture of cracked wax olefins, 1-hexadecanol and 1-octadecanol, etc.

The Oxo alcohols mentioned above are isomeric mixtures of branched chain aliphatic primary alcohols prepared from olefins, such as cracked waxes and polymers and copolymers of $C_3$ to $C_4$ monoolefins, reacted with CO and hydrogen in the presence of a cobalt-containing catalyst such as cobalt carbonyl, at temperatures of about 300° to 400°F., under pressures of about 1000 to 3000 psi., to form aldehydes. The resulting aldehyde product is then hydrogenated to form the Oxo alcohol which is then recovered by distillation.

The amides can be formed in a conventional manner by heating the amine and acid with the removal of any water generated by the action. Similarly the monoester is prepared in a conventional manner by heating the alcohol and the acid to effect the reaction and provoke removal of the water of reaction if generated from the reaction environment. The salts are also conventionally prepared by simply mixing secondary amine and the monoester or monoamide of the acid together with stirring at room temperature, e.g. 25°C., or by blowing ammonia through the acid.

Particularly preferred are nitrogen compounds of the above type that are prepared from dicarboxylic acids, optimally the aliphatic dicarboxylic acids, which appear to be generally more effective than compounds prepared from monocarboxylic acids or tricarboxylic acids.

THE WAXY HYDROCARBONS (a) Amorphous Solid Materials

The preferred waxy hydrocarbons are generally amorphous solid materials having melting points within the range of about 25° to 60°C. and number average molecular weights within the range of about 600 to about 3000, e.g. 600 to 2500, preferably 600 to 1500. This molecular weight range is above the highest molecular weight of any hydrocarbons that are naturally present in a middle distillate fuel oil or diesel fuel. These preferred waxy materials are essentially free of normal paraffinic hydrocarbons, i.e. they will normally contain no more than 5 wt. % of normal paraffin, preferably 3 wt. % or less and most preferably no more than about 1 wt. % of normal paraffin hydrocarbons.

These amorphous hydrocarbon fractions can be obtained by deasphalting a residual petroleum fraction and then adding a solvent such as propane to the deasphalted residuum, lowering the temperature of the solvent-diluted residuum, and recovering the desired solid or semi-solid amorphous material by precipitation at a low temperature followed by filtration. The residual oil fractions from which the desired hydrocarbons are obtained will have viscosities of at least 125 SUS at 99°C. Most of these residual oils are commonly referred to as bright stocks. In some instances, products obtained by this procedure will be naturally low in normal paraffin hydrocarbons depending on the crude source. For example, by low temperature propane treatment of a deasphalted residual oil from certain Texas coastal crudes, a precipitated high molecular weight amorphous fraction can be obtained which has only a trace of normal paraffins, about 5% of isoparaffins, about 73% of cycloparaffins and about 22% of aromatic hydrocarbons.

If the crude source normally contains normal paraffins, it is generally desirable to treat the high molecular weight wax fraction to reduce its content of normal paraffins as by complexing with urea, solvent extraction procedures or other techniques known to the art. To illustrate, the amorphous hydrocarbon mixture with n-paraffin present can be dissolved in a ketone, e.g. methylethyl ketone, at its boiling point, and then when the solution is cooled to room temperature the normal paraffins will be predominantly precipitated and the resultant supernatant solution will give a mixture containing some normal paraffins but predominating in cycloparaffins and isoparaffins, which are the desired waxy material.

In the following working examples, the essentially saturated waxy hydrocarbon fraction (Waxy Hydrocarbon A) that was used was an amorphous solid hydrocarbon fraction having a melting point of 43°C., obtained by propane precipitation from a deasphalted residual stock from a Texas coastal crude oil. This hydrocarbon fraction was found by mass spectrographic analysis and gas chromatography to contain 5 wt. % of isoparaffins, 22 wt. % of aromatic hydrocarbons, 73 wt. % of cycloparaffins, and no more than a trace of normal paraffin hydrocarbons. The number average molecular weight of this material was about 775 as determined by Vapor Pressure Osmometry (VPO). The distillation characteristics of this solid amorphous hydrocarbon fraction were as follows:

| (ASTM D-1160) | Vapor Temp. at 5 mm Hg. | Vapor Temperature Converted to Atmospheric Pressure |
|---|---|---|
| Initial BP | 227°C. | 401°C. |
| 5% | 310 | 497 |
| 10% | 336 | 526 |
| 20% | 363 | 557 |
| 24% | 365 | 558 |

Only 24% would distill over. There were 75% bottoms and 1% loss.

(b) Alkylated Aromatics

Another waxy hydrocarbon material of the invention are the Friedel-Crafts condensation reaction products of a halogenated paraffin with an aromatic hydrocarbon. These materials are well known in the art, primarily as lube oil pour depressants and as dewaxing aids, e.g. see U.S. Pat. Nos. 1,815,022, 2,174,246, 2,297,292, 3,245,766 and 3,458,430. Usually, the halogneated paraffin will contain from about 12 to about 50, e.g. 16 to about 45 carbon atoms and from about 5 to about 25, e.g. 10 to 18 wt. % chlorine. Typically, the halogenated paraffins used to prepare this well known class of wax modifiers are themselves prepared by chlorinating to the above recited chlorine content a paraffin wax having a melting point within the range of about 50° and 90°C. The aromatic hydrocarbon used herein usually contains a maximum of three substituent groups and/or condensed rings and may be a hydroxy compound such as phenol, cresol, xylenol, or an amine such as aniline, but is preferably naphthalene, phenanthrene or anthracene.

(C) Others

Other waxy hydrocarbon and suitable derivatives or substitutes include: microcrystalline wxes, isomerized waxes, oxidized waxes and natural waxy esters and glycerides such as bees wax, and completely sunthetic materials such as olefin copolymers, e.g. a copolymer of $C_{12}$to $C_{30}$ alpha-olefins made by the Ziegler-Natta process.

Waxy Hydrocarbon B of the following working examples is an alkylated naphthalene made by chlorinating a 7320 C. melting point wax containing 24 to 44 carbon atoms per molecule with an average carbon number of 34, to 12% chlorine, and then condensing 100 parts of this chlorinated wax with 8.8 parts of naphthalene by the Friedel-Crafts reaction as has been described, said wax predominating in n-paraffins.

THE ETHYLENE BACKBONE POUR DEPRESSANT

In general, these polymeric pour depressants have a polymethylene backbone which is divided into segments by hydrocarbon or oxy-hydrocarbon side chains. Generally, they will comprise about 3 to 40, preferably 4 to 20, molar proportions of ethylene per molar proportion of a second ethyleneically unsaturated monomer, which latter monomer can be a single monomer or a mixture of such monomers in any proportion. These oil-soluble polymers will generally have a number average molecular weight $\overline{Mn}$ in the range of about 1,000 to 50,000, as measured by Vapor Pressure Osmometry, such as by using a Mechrolab Vapor Pressure Osmometer Model 310A.

The unsaturated monomers, copoloymerizable with ethylene, include unsaturated mono- and diesters of the general formula:

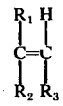

wherein $R_1$ is hydrogen or methyl; $R_2$ is a —$OOCR_4$ or —$COOR_4$ group wherein $R_4$ is hydrogen or a $C_1$ to $C_{16}$, preferably a $C_1$ to $C_4$, straight or branched chain alkyl group; and $R_3$ is hydrogen or —$COOR_4$. The monomer, when $R_1$ and $R_3$ are hydrogen and $R_2$ is —$OOCR_4$ includes vinyl alcohol esters of $C_2$ to $C_{17}$ monocarboxylic acids, preferably $C_2$ to $C_5$ monocarboxylic acid. Examples of such esters inlcude vinyl acetate, vinyl isobutyrate, vinyl laurate, vinyl myristate, vinyl palmitate, etc. When $R_2$ is —$COOR_4$, such esters include methyl acrylate, isobutyl acrylate, and lauryl acrylate. When $R_1$ is methyl and $R_3$ is hydrogen, the esters include palmityl alcohol ester of alpha-methyl-acrylic acid, (methacrylic acid), the $C_{13}$ Oxo alcohol esters of methacrylic acid, etc. Examples of monomers where $R_1$ is hydrogen and $R_2$ and $R_3$ are —$COOR_4$ groups, include mono- and diesters of unsaturated dicarboxylic acids such as: mono $C_{13}$ Oxo fumarate, di-$C_{13}$ Oxo fumarate, di-isopropyl maleate; dilauryl fumarate; ethyl methyl fumarate; etc.

Another class of monomers that can be copolynmerized with ethylene include $C_3$ to $C_{16}$ alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained by chlorinating polyethylene. Or as previously mentioned, branched polyethylene can be used per se as the pour depressant.

These copolymer pour depressants are generally formed using a free radical promoter, or in some cases they can be formed by thermal polymerization, or they can be formed by Ziegler catalysis in the case of ethylene with other olefins. The polymers produced by free radical appear to be the more important and can be formed as follows: Solvent, and 0–50 wt. %, of the total amount of monomer other than ethylene, e.g. an ester monomer, used in the batch, are charged to a stainless steel pressure vessel which is equipped with a stirrer. The temperature of the pressure vessel is then brought to the desired reaction temperature, e.g. 70° to 250°C., and pressured to the desired pressure with ethylene, e.g. 800 to 10,000 psig, usually 900 to 6000 psig. Then promoter, usually dissolved in solvent so that it can be pumped, and additional amounts of the second monomer, e.g. unsaturated ester, are added to the vessel continuously, or at least periodically, during the reaction time, which continuous addition gives a more homogeneous copolymer product as compared to adding all the unsaturated ester at the beginning of the reactionl Also during this reaction time, as ethylene is consumed in the polymerization reaction, additinal ethylene is supplied through a pressure controlling regulator so as to maintain the desired reaction pressure fairly constant at all times. Following the completion of the reaction, usually a total reaction time of ¼ to 10 hours will suffice, the liquid phase of the pressure vessel is distilled to remove the solvent and other volatile constituents of the reacted mixture, leaving the polymer as residue. Usually, to facilitate handling and later oil blending, the polymer is dissolved in a light mineral oil to form a concentrate usually containing 10 to 60 wt. % polymer.

Usually, based upon 100 parts by weight of copolymer to be produced, then about 50 to 1200, preferably 100 to 600, parts by weight of solvent usually a hydrocarbon solvent such as benzene, hexane, cyclohexane, etc. and about 5 to 20 parts by weight of promoter will be used.

The promoter can be any of the conventional free radical promoters, such s peroxide or azo-type poromoters, including the acyl peroxides of $C_2$ to $C_{18}$ branched or unbranched carboxyalic acids, as well as other common promoters. Specific examples of promoters include di-benzoyl peroxide, ditertiary butyl peroxide, tertiary butyl perbenzoate, tertiary butyl hydroperoxide, alpha, alpha', azodiisobutyronitrile, dialuroyl peroxide, etc.

THE DISTILLATE FUELS

The distillate fuel oils usually have boiling ranges of about 120°C. to about 370°C. The fuel oil can comprise straight run or virgin gas oil or cracked gas oil or a blend in any proportion of straight run and thermally and/or catalytically cracked distillates. The most common petroleum middle distillate fuels are kerosene, diesel fuels, jet fuels and heating oils. The low temperature flow problem is most usually encountered with diesel fuels and with heating oils.

A reprsentative heating oil specification calls for a 10% distillation point no higher than about 227°C., a 50% point no higher than about 272°C., and a 90% point of at least 282°C. and no higher than about 340°C. to 345°C., although some specifications set the 90% point as high as 357°C.

A reprsentative specification for a diesel fuel includes a minimum flash point of 38°C. and a 90% distillation point between 282°C. and 338°C. (See ASTM Designations D-496 and D-975).

The final composition of the i nvention will generally comprise a major amount of the distillate fuel and a minor amount of the combination of: from about 0.001 to 1 wt. %, preferably 0.005 to 0.15 wt. % of the aforementioned nitrogen compound; and about 0.005 to 0.30, preferably 0.01 to 0.10 wt. % of the waxy hydrocarbon and/or about .001 to 2 wt. %, preferably 0.005 to 0.10 wt. % of the aforedescribed ethylene backbone pour point depressant and, if desired, 0.001 to 0.10 wt. % of an amine. Said weight percents are based on the weight of the total composition. It must be understood as used this final composition may includeother commonly used additives, i.e., anti-oxidants, combustion improvers, anti-haze agents, etc.

The invention will be further understood by reference to the following Examples which include preferred embodiments of the invention.

EXAMPLES

In carrying out the Examples, the following additive materials were used:

The Wax Additives

Waxy Hydrocarbon A was previously described.

Waxy Hydrocaron B is wax-naphthalene made from 100 parts by weight of a 73°C. melting point n-paraffin wax chlorinated to 12 wt. % Cl and condensed with 8.8 parts naphthalene (Friedel-Crafts) as has been described.

The Nitrogen Compounds

C is a maleic monoamide from secondary hydrogenated tallow amine (505 mol. wt.) which is 92% neutralized with the same amine.

D is 96.6 wt. % maleic diamide and 3.4 wt. % maleic monoamide from secondary hydrogenated tallow amine.

E is dialkyl stearamide prepared from stearic acid and secondary hydrogenated tallow amine.

F is maleic mono-octadecyl ester, secondary hydrogenated tallow amine salt.

G is maleic mono-octadecyl ester mono-amide from secondary hydrogenated tallow amine.

H is maleic mono-$C_{32}$ ester ($C_{323}$ alcohol from Geurbet dimerized 1-hexadecanol) neutralized with secondary hydrogenated tallow amine.

I is fumaric mono-amide from secondary hydrogenated tallow amine, neutralized with secondary hydrogenated tallow amine (a fumaramic acid salt).

J is maleic acid esterified as in Example H and then condensed with secondary hydrogenatd tallow amine to form an amide which is an ester of a maleamic acid.

K is a maleamic acid prepared by condensing one mole of maleic anhydride with one mole of mixed secondary amines. The alkyl groups of said amines range from about 8 to about 18 carbon atoms.

L is maleic acid esterified with $C_{12}$ to $C_{18}$ cracked wax Oxo alcohols and then neutralized with secondary hydrogenated tallow amine to form an ester-salt of a maleic acid.

M is a diamide prepared from adipic acid and secondary hydrogenated tallow amine.

The secondary hydrogenated tallow amine used herein is a commercially available product sold by Armak Co., Chemicals Division, Chicago, Illinois and designated Armeen 2HT.

It is the nature of the chemical reactions used to prepare these nitrogen containing materials that, in addition to the chief constituent of each preparation, there will also be present in varying amounts byproducts and unreacted starting materials. The composition, molecular structures and formulas for the chief constituents, which are of interest here, because of their wax-modifying activity are further described in Table I.

TABLE I

DESCRIPTION OF WAX MODIFIERS OF THIS INVENTION

| Nitrogen-Containing Material | Structure and Composition of Principal Component[1] | Empirical Formula |
|---|---|---|
| C | 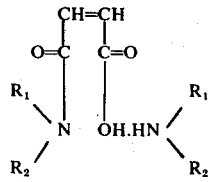 Salt of Maleamic Acid or N,N dialkyl maleamic acid salt | $C_{72}H_{144}O_3N_2$ |
| D | 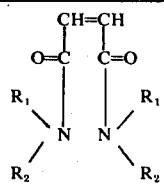 Maleic Diamide or N,N,N',N'tetra($C_{14-18}$ alkyl) maleic diamide | $C_{72}H_{142}O_2N_2$ |
| E | 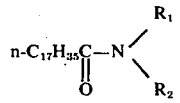 N,N dialkyl stearamide or N,N,di($C_{14-18}$ alkyl) stearamide | $C_{52}H_{105}O\ N$ |
| F | 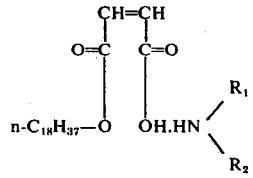 Ester/Salt of Maleic Acid or Di($C_{14-18}$) ammonium salt of mono-1-octadecyl maleate | $C_{56}H_{111}O_4N$ |
| G | 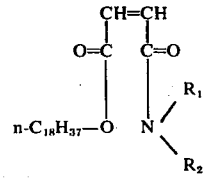 Ester of Maleamic Acid or mono-1-octadecyl N,N di($C_{14-18}$) maleamate | $C_{56}H_{109}O_3N$ |
| H | 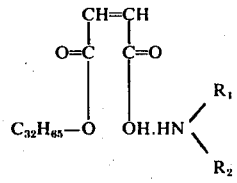 Ester/Salt of Maleic Acid (From Guerbet alcohol) or di($C_{14-18}$) ammonium salt of mono-1-octadecyl (2 tetradecyl)maleate. | $C_{70}H_{139}O_4N$ |
| I | 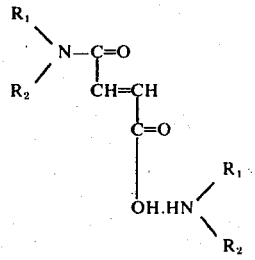 Salt of Fumaramic acid or di($C_{14-18}$) ammonium N,N | $C_{72}H_{144}O_3N_2$ |

TABLE I-continued

DESCRIPTION OF WAX MODIFIERS OF THIS INVENTION

| Nitrogen-Containing Material | Structure and Composition of Principal Component[1] | Empirical Formula |
|---|---|---|
| | di($C_{14-18}$ alkyl) fumaramate | |
| J | 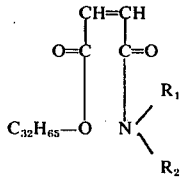 Ester of Maleamic Acid (From Guerbet Alcohol) or mono-1-octadecyl (2-tetradecyl) N,N di($C_{14-18}$ alkyl) maleamate | $C_{70}H_{137}O_3N$ |
| K | 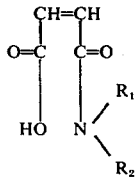 Maleamic acid from Coconut and Tallow Amines or N,N-di ($C_{8-18}$ alkyl) maleamic acid | $C_{35}H_{67}O_3N$ |
| L | 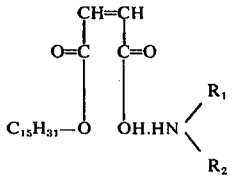 Ester/Salt of Maleic Acid (Ester from Cracked Wax Oxo Alcohols) or di($C_{14-18}$) ammonium salt of monoester ($C_{12-18}$ cracked wax alcohols) of maleic acid. | $C_{55}H_{105}O_4N$ |
| M | 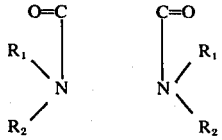 Adipic Diamide or N,N,N',N'tetra($C_{14-18}$ alkyl) diamide of adipic acid | $C_{74}H_{148}O_2N_2$ |

[1]Further Description of Composition:
For all examples the n-alkyl groups of the

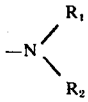

group, drived from tallow fat, are 3% $C_{14}H_{29}$, 34% $C_{16}H_{33}$ and 63% $C_{18}H_{37}$, for an average composition of $N(C_{17.3}H_{35.6})_2$, except for Example K where these n-alkyl groups derived from coco and tallow fats are 2.5% $C_8H_{17}$, 2.3% $C_{10}H_{21}$, 19.1% $C_{12}H_{25}$, 8.8% $C_{14}H_{29}$, 24.8% $C_{16}H_{33}$ and 43.5% $C_{18}H_{37}$ for an average composition of $N(C_{15.6}H_{32.2})_2$. For the empirical formulas given in the third column of this table these compositions are rounded to $N(C_{17}H_{35})_2$ and $N(C_{15.5}H_{32})_2$.

In Example H the alcohol used for esterification ($C_{32}H_{65}OH$) was made by the Guerbet condensation of 1-hexadecanol.

In Example L the alcohol used for esterification was a mixture of $C_{12}$ to $C_{18}$ Oxo alcohols averaging $C_{15}H_{31}OH$ made from cracked petrolatum wax.

The foregoing nitrogen-containing materials are prepared by straight forward techniques. For example, the preparation of C, i.e. maleic monoamide from secondary hydrogenated tallow amine, is as follows:

Ten grams (0.102 mole) of maleic anhydride, 10.0 gm. (0.198 mole) of seondary hydrogenated tallow amine of a molecular weight of 505, and 200 ml. of benzene as a solvent were heated for 3 hours at 85°C. in a 4-neck flask equipped with stirrer, thermometer, condenser and water trap. No water formed under these conditions. The reaction mixture was removed and the solvent evaporated off on a hot plate to give 109.3 gms. of a maleamic acid salt, melting point 64°C.

Material D was prepared by heating a portion of material C at 170 to 200°C. for 2 hours. The weight loss was 2.0%, which is slightly greater than the theoretical water weight loss of 1.65%, to form the diamide of maleic acid and secondary hydrogenated tallow amine. The produce had a melting pont of 49°C.

Material E, an N,N-dialkyl stearamide, was prepared, from stearic acid and secondry hydrogenated tallow amine under conditions similar to those used for Material D.

Several mono-esters of maleic anhydride were prepaed to be used as intermediates for further preparation of nitrogen-containing salts and amides.

A typical preparation is as follows:

Maleic anhydride (9.8 gm. 0.10 mole) 22.4 g. (0.10 mole) of Oxo alcohol frm cracked wax and 250 ml. of benzene as solvent were heated for 3 hours at 84°C. in a 4-neck flask equipped with stirrer, thermometer, condeser. Under these conditions, the mono-ester of maleic anhydride formed very readily, even in the absence of catalyst.

The Oxo alcohol was prepared by the well known commercial Oxo process by subjecting a mixture of cracked wax olefins to CO and $H_2$ under pressure in the presence of a metal carbonyl catalyst. The mixture of alcohols ranged from 12 to 18 and averaged 15 in carbon number, and had a molecular weight of 224.

In a similar fashion, monoesters of 1-octadecanol and a $C_{32}$ Guerbet Dimer alcohol were prepared. The $C_{32}$ alcohol, which was actually 2-tetradecyl 1-octadecanol, was prepared by heating 1.5 moles of 1-hexadecanol in the presence of 0.1 mole of sodium alcoholate at 200°C for 10 hours.

In summary, the specific esters prepared ae listed below:

| Mono-Esters Prepared from Maleic Anhydride | | |
|---|---|---|
| Ester | Alcohol Description | Alcohol Mol. Wt. |
| 1 | Oxo Alcohol from Cracked Wax | 224 |
| 2 | 1-Octadecanol | 270 |
| 3 | $C_{32}$ Guerbet Dimer Alcohol | 466 |

The mono-esters were not isolated as pure compounds, but were used in a solution as formed to prepare salts and amides of a secondary hydrogenated tallow amine.

The amine had the formula

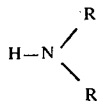

where the R's are straight chain alkyl groups derived from hydrogenated tallow and are about 3% $C_{14}$ alkyl groups, 34% $C_{16}$ alkyl groups and 63% $C_{18}$ alkyl groups in a manner previously illustrated.

Esters 1, 2 and 3 were converted to salts of the secondary hydrogenated tallow amine to form nitrogen-containing Materials L, F and H respectively, while esters 2 and 3 were also usd to form amides, nitrogen-containing Materials G and J, respectively, of Tables I and II.

A typical salt preparation is that of F, the secondary hydrogenated tallow amine neutral salt of maleic mono-octadecyl ester. Here the ester was prepared as follows:

Twenty-seven gms. (0.10 moles) of the octadecyl alcohol, 9.8 gms. (0.10 moles) of the maleic acid, and 250 ml. of benzene solvent were charged to a flask equipped with a stirrer, thermometer, condenser and charging tube. The mixture was heated to 82°C. for about 3 hours.

The salt was prepared by simply mixing stoichiometric amounts of the amine and the above ester in solution as prepared above, i.e. 50 gms. (0.098 moles) of amine with the ester, were heated for 2 hours at 85°C. The salt was then recoverd by evaporating the solvent on the steam bath. The yield was 89.6 gm. and the product had a melting point of 68°C.

THE ETHYLENE BACKBONE POUR DEPRESSANT

Pour depresssant N is a concentrate of 55 wt. % light mineral oil and 45 wt. % of an ethylene-vinyl acetayte copolymer having a number average molecular weight (Mn) of about 2,230 as determined by Vapor Pressure Osmometry and having about 1.5 methyl terminated branches per 1,000 molecular weight of polymer and a relative molar ratio of about 4.7 moles of ethylene per mole of vinyl acetate. The copolymer was prepared by copolymerizing 61 wt. % ethylene and 39 wt. % vinyl acetate with dilauryl peroxide at a temperature of about 105°C. and under about 950 psi ethylene pressure.

The Fuel Oils

Fuel Oils I to III all, No. 2 diesel fuels, having the following characteristics, were used:

| Fuel | Cloud Pt.°C. | Pour Pt.°C. | Aniline Pt.°C. | Distillation Range,°C. |
|---|---|---|---|---|
| I | −14.4 | −17.8 | 64 | 182–338 |
| II | −16.7 | −20.6 | 66 | 184.337 |
| III | −17.8 | −23.3 | 61 | 178–334 |

The Flow Test

The Flow Test was carried out by cooling the oil sampled of 200 ml. at a controlled rate of 2.2° per hour to the desired temperature, usually −27.8°C., and then testing the oil by pulling it through a 1 centimeter diameter 270 mesh screen under 36 inches of water vacuum and measuring the time for the oil sample to pass through the screen. Both the time in seconds was reported, and "Pass" to indicate the sample passed through in 60 seconds or less, or "Fail" to indicate the sample had not totally passed through in 60 seconds, at which time the test was terminated.

Various blends were made up of the above-noted additives and oils and subjected to the Flow Test. The results are summarized in the following Tables III through VII; Table III being an experimental study of the additive blends influence on Fuels I and II; and Tables IV–VII being an experimental portrayal of the additive blends influence on Fuel III.

TABLE III

FLOW TEST RESULTS

| | Additive Blend | | | | | Flow Test Results at −27.8°C. | | |
|---|---|---|---|---|---|---|---|---|
| | Nitrogen Compound | | Waxy Hydrocarbon | | Total | | | |
| Fuel | Code | Wt.%* | Code | Wt.%* | Wt.%* | Flow | Sec. | Rating |
| I | C | 0.150 | A | 0.135 | 0.285 | 100 | 35 | Pass |
| I | D | 0.065 | A | 0.035 | 0.100 | 100 | 35 | Pass |
| I | D | 0.053 | B | 0.087 | 0.140 | 100 | 35 | Pass |
| I | — | 0.000 | A | 0.300 | 0.300 | 0 | 60 | Fail |
| II | C | 0.150 | A | 0.135 | 0.285 | 100 | 30 | Pass |
| II | D | 0.060 | A | 0.030 | 0.090 | 100 | 25 | Pass |
| II | D | 0.053 | B | 0.087 | 0.140 | 100 | 26 | Pass |
| II | — | 0.000 | A | 0.300 | 0.300 | 0 | 60 | Fail |

*weight percent active ingredient based on weight of fuel

TABLE IV

FLOW TEST RESULTS

| Additive Blend | | | | | Flow Test Result at −27.8°C. | | |
|---|---|---|---|---|---|---|---|
| Nitrogen Compound | | Waxy Hydrocarbon | | Total | | | |
| Code | Wt.%* | Code | Wt.%* | Wt.%* | Flow % | Sec. | Rating |
| C | 0.100 | A | 0.090 | 0.190 | 100 | 25 | Pass |
| D | 0.024 | A | 0.011 | 0.035 | 100 | 24 | Pass |
| F | 0.100 | A | 0.090 | 0.190 | 100 | 22 | Pass |
| G | 0.100 | A | 0.090 | 0.190 | 100 | 24 | Pass |
| H | 0.100 | A | 0.090 | 0.190 | 100 | 24 | Pass |
| I | 0.060 | A | 0.090 | 0.150 | 100 | 25 | Pass |
| K | 0.060 | A | 0.030 | 0.090 | 100 | 22 | Pass |
| L | 0.075 | A | 0.090 | 0.165 | 100 | 28 | Pass |
| M | 0.100 | A | 0.090 | 0.190 | 100 | 26 | Pass |
| H | 0.021) | A | 0.042 | 0.088 | 100 | 22 | Pass |
| J | 0.025) | | | | | | |
| — | 0.0 | A | 0.150 | 0.150 | 0 | 60 | Fail |
| — | 0.0 | A | 0.300 | 0.300 | 0 | 60 | Fail |
| C | 0.060 | B | 0.100 | 0.160 | 100 | 33 | Pass |
| D | 0.038 | B | 0.062 | 0.100 | 100 | 24 | Pass |
| D | 0.026) | B | 0.088 | 0.140 | 100 | 24 | Pass |
| E | 0.026) | | | | | | |
| I | 0.060 | B | 0.100 | 0.160 | 100 | 25 | Pass |
| K | 0.060 | B | 0.100 | 0.160 | 100 | 25 | Pass |
| M | 0.100 | B | 0.100 | 0.200 | 100 | 29 | Pass |
| — | 0.0 | B | 0.200 | 0.200 | 0 | 60 | Fail |

*weight percent active ingredient based on weight of Fuel III

TABLE V

FLOW TEST RESULTS

| Blend | | | | | Flow Test Results at −27.8°C. | | |
|---|---|---|---|---|---|---|---|
| Nitrogen Compound | | Pour Depressant | | Total | | | |
| Code | Wt.%* | Code | Wt.%* | Wt.%* | % Flow | Sec. | Rating |
| C | 0.020 | N | 0.020 | 0.040 | 100 | 24 | Pass |
| F | 0.075 | N | 0.040 | 0.115 | 100 | 28 | Pass |
| L | 0.075 | N | 0.040 | 0.115 | 100 | 28 | Pass |
| — | 0.000 | N | 0.220 | 0.220 | 0 | 60 | Fail |

*weight percent active ingredient based on weight of Fuel III

TABLE VI

FLOW TEST RESULTS

| BLEND | | | | | | | Flow Test Results at −27.8°C. | | |
|---|---|---|---|---|---|---|---|---|---|
| Nitrogen Compound | | Pour Depressant | | Third Component | | Total | | | |
| Code | Wt.%* | Code | Wt.%* | Code | Wt.%* | Wt.%* | % Flow | Sec | Rating |
| C | 0.014 | N | 0.020 | (HTA)** | 0.006 | 0.040 | 100 | 26 | Pass |
| M | 0.080 | N | 0.018 | A*** | 0.090 | 0.188 | 100 | 31 | Pass |

TABLE VI-continued

FLOW TEST RESULTS

| BLEND | | | | | | | | | |
|---|---|---|---|---|---|---|---|---|---|
| Nitrogen Compound | | Pour Depressant | | Third Component | | Total | Flow Test Results at −27.8°C. | | |
| Code | Wt.%* | Code | Wt.%* | Code | Wt.%* | Wt.%* | % Flow | Sec | Rating |
| C | 0.014 | N | 0.020 | — | 0.000 | 0.034 | 0 | 60 | Fail |

*weight percent active ingredient based on weight of Fuel III.
**(HTA) = Secondary hydrogenated tallow amine as described.
***Waxy hydrocarbon as described.

TABLE VII

| Nitrogen Compound | | Second Component | | Total | Flow Test Results at −27.8°C. | | |
|---|---|---|---|---|---|---|---|
| Code | Wt.%* | Code | Wt.%* | Wt.%* | % Flow | Sec. | Rating |
| D | 0.025 | A | 0.011 | 0.036 | 100 | 27 | Pass |
| O[1] | 0.025 | A | 0.011 | 0.036 | 3 | 60 | Fail |
| O[1] | 0.022 | A | 0.036 | 0.058 | 2 | 60 | Fail |
| O[1] | 0.025 | A | 0.043 | 0.068 | 100 | 23 | Pass |
| C | 0.020 | N | 0.020 | 0.040 | 100 | 24 | Pass |
| L | 0.075 | N | 0.040 | 0.115 | 100 | 28 | Pass |
| O[1] | 0.050 | N | 0.023 | 0.073 | 97 | 60 | Borderline |
| O[1] | 0.050 | N | 0.090 | 0.140 | 90 | 60 | Fail |
| O[1] | 0.100 | N | 0.045 | 0.145 | 100 | 48 | Pass |

[1]O is N,N-dialkyl alkenylsuccinamic acid which was purchased from Chevron Chemical Co., San Francisco California as Oronite FA 410. Alkyl groups average about $C_{17}$ and alkenyl groups $C_{19}$.
*weight percent active ingredient based on weight of Fuel III.

Tables III and IV show that the inventive combination of the nitrogen-containing materials and the waxy hydrocarbons are very effective in improving the low temperature flow properties of the three diesel fuels described in the specification. Used alone, the waxy hydrocarbons are incapable of effecting this improvement, even when present at concentrations substantially greater than the total concentration of the inventive combination. Table III shows the relative inactivity of Waxy Hydrocarbon A in Fuels I and II. Table IV shows the relatively inactivity of Waxy Hydrocarons A and B in Fuel III.

Table V shows the good activity of the nitrogen compounds of the invention in combination with an ethylene/vinyl acetate copolymer pour point depressant in improving the low temperature filterability of a diesel fuel. Although the ethylene/vinyl acetate copolymer is a commercially used pour point depressant for middle distillates used alone, it is less effective for low temperature filter improvement for these fuels, as are the nitrogen compounds used alone.

Table VI shows that the invention is not limited to two-component systems, but that three or more components in the flow improver are useful according to this invention.

Table VII shows the superiority of the inventive combination, a combination of a waxy hydrocarbon and a commercially available cold flow improving additive for middle distillates. This additive as earlier noted as an alkenyl succinamic acid derivative which falls within the subject matter of U.S. Pat. Nos. 3,44,082 and 3,544,467.

It must be noted that Table VI demonstrates a modification of the invention combination wherein an amine is utilized to enhance the activity of the combination. The preferred amine for this purpose is secondary hydrogenated tallow amine, however, other useful amines are dialkyl amines wherein at least one alkyl group contains from about 8 to about 30 carbons; preferably both alkyl groups should contain from 10 to 24 carbons each. Useful amounts of said dialkyl amines are from about 0.001 to 0.05 wt. % of the total fuel composition.

The nitrogen-containing compounds of the invention can have their oil-solubility tailored as desired by adjustment of the linearity or branching and length of the alkyl groups, i.e. R, $R_1$ and $R_2$ of the compounds. Although neutral salts of the nitrogen-containing compounds have been exemplified, it is to be understood the partially neutralized salts can be used as well as combinations in which an excess of amine is present.

The inventive combination of the nitrogen-containing materials and waxy hydrocarbons and/or ethylene copolymers are normally formulated, transported and blended, into the middle distillates to be treated, as concentrates containing 5 to 90 wt. % total active ingredients and 95 to 10 wt. % solvent, preferably a petroleum fraction containing a substantial proportion of aromatic constituents, or toluene, or a mixture of xylenes, ethyl benzenes, etc.

By oil or fuel soluble, with regard to the nitrogen-containing compounds, is meant that the aforesaid amide and/or salt additives will dissolve in amounts of at least 0.1 wt. % in the fuel oil at room temperature, e.g. about 25°C. although, as the fuel oil is cooled to wax crystallizing temperature, at least some of the additive apparently will also crystallize from the oil either before or with the wax in order to modify the wax crystals that form.

As earlier noted, it has been found that the nitrogen-containing additives of the invention possess cold flow improving activity in middle distillates. Useful activity is observed at total concentrations of one or more of said nitrogen-containing additives of from about 0.05 to about 1.0 weight percent based on the total weight of the middle distillate.

In summary, the invention relates to use per se, or in combination with the aforesaid waxy hydrocarbon and/or ethylene backbone pour depressants of oil-soluble nitrogen-containing, flow-improving compounds having of a total of from 20 to 90 carbon atoms, preferably from 30 to 80 carbon atoms.

It is to be understood that the examples present in the foregoing specification are merely illustrative of this invention and are not intended to limit it in any manner; nor is the invention to be limited by any theory regarding its operability. The scope of the invention is to be determined by the appended claims.

What is claimed is:

1. A fuel oil composition comprising a major amount of a middle distillate fuel oil, and a cold flow improving synergistic mixture of:

A. in the range of about 0.005 to 0.5 weight percent of a nitrogen compound selected from the group consisting of:

a. N,N-dialkyl n-alkane amides of the formula

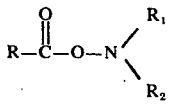

wherein R is $C_1$ to $C_{30}$ alkyl group, and $R_1$ and $R_2$ are each $C_8$ to $C_{24}$ straight chain alkyl groups; and b. $C_4$ to $C_{10}$ hydrocarbyl aliphatic dicarboxylic acid wherein one of said carboxylic acid groups is reacted with either $C_{14}$ to $C_{36}$ aliphatic hydrocarbyl alcohol or a secondary alkyl monoamine having $C_{10}$ to $C_{24}$ straight chain alkyl groups, to thereby form a monoester or a monoamide, and the other of said carboxylic acid groups is reacted to form an amide or salt with a secondary alkyl monoamine having $C_{10}$ to $C_{24}$ straight chain alkyl groups; and at least one other additive selected from the group consisting of:

B. in the range of 0.002 to 0.2 weight percent of an ethylene backbone pour point depressant which is a copolymer of 4 to 20 molar proportions of ethylene and molar proportion of unsaturated ester of the general formula:

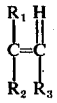

wherein $R_1$ is hydrogen or methyl, and $R_2$ is a —$OOCR_4$ or —$COOR_4$ group wherein $R_3$ is hydron or —$COOR_4$ and $R_4$ is hydrogen or a $C_1$ to $C_{16}$ alkyl group, said copolymer having a number average molecular weight in the range of about 1,000 to 50,000; and/or C. in the range of about 0.005 to 0.30 weight percent of waxy material selected from the group consisting of:

a. amorphous hydrocarbon fraction having a number average molecular weight of about 600 to 3000, a melting point in the range of about 25° to 60°C., and having no more than about 5 weight percent of normal paraffins;

b. akylated aromatic formed by reacting paraffins of about 12 to about 50 carbon atoms, chlorinated to about 5 to 25 weight percent chlorine, with an aromatic hydrocarbon selected from the group consisting of phenol and naphthalene; and c. microcrystalline wax.

2. A fuel oil consumpton according to claim 1, wherein said other additive is said ethylene backbone pour depressant.

3. A fuel oil composition according to claim 1, wherein said other additive is said waxy material.

4. A fuel oil composition according to claim 1, wherin said other additive is a mixture of said ethylene backbone pour depressant and said waxy material.

5. A fuel oil composition according to claim 2, wherein said ethylene backbone pour depressant is a copolymer of ethylene and vinyl acetate.

6. A fuel oil composition according to claim 3, wherein said waxy material is said amorphous hydrocarbon fraction.

7. A fuel oil composition according to claim 3, wherein said waxy material is said alkylated aromatic.

8. A fuel oil composition according to claim 1, wherein said nitrogen compound is a $C_4$ dicarboxylic acid having both of its carboxylic acid groups reacted with secondary alkyl monoamine having alkyl groups essentially of 14 to 18 carbon atoms.

9. A fuel oil composition according to claim 8, wherein said other additive is said ethylene backbone pour depressant.

10. A fuel oil composition according to claim 8, wherein said other additive is said waxy material.

11. A fuel oil composition according to claim 8, wherein said other additive is a mixture of said ethylene backbone pour depressant and said waxy material.

12. A fuel oil composition according to claim 9, wherein said ethylene backbone pour depressant is a copolymer of ethylene and vinyl acetate.

13. A fuel oil composition according to claim 10, wherein said waxy material is said amorphous hydrocarbon fraction.

14. A fuel oil composition according to claim 11, wherein said waxy material is said alkylated aromatic.

* * * * *

UNITED STATES PATENT AND TRADEMARK OFFICE

CERTIFICATE OF CORRECTION

PATENT NO. : 3,982,909

DATED : September 28, 1976

INVENTOR(S) : William C. Hollyday, Jr.

It is certified that error appears in the above-identified patent and that said Letters Patent are hereby corrected as shown below:

Column 5, line 39, cancel "halogneated" and substitute --halogenated--.

Column 10, about lines 37 to 42, correct the formula by adding the missing valence lines so as to read:

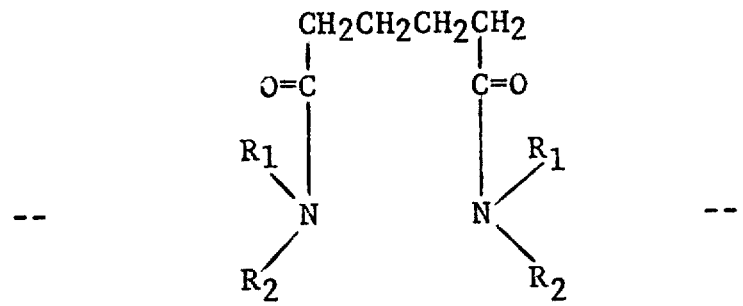

Column 17, lines 17 to 24, correct the formula to read:

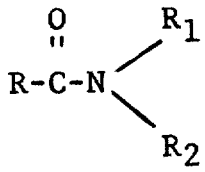

UNITED STATES PATENT AND TRADEMARK OFFICE
CERTIFICATE OF CORRECTION

PATENT NO. : 3,982,909
DATED : September 28, 1976
INVENTOR(S) : William C. Hollyday, Jr.

It is certified that error appears in the above-identified patent and that said Letters Patent are hereby corrected as shown below:

Column 17, lines 42 to 48, correct the formula to read:

-- $\begin{array}{ccc} R_1 & & H \\ | & & | \\ C & = & C \\ | & & | \\ R_2 & & R_3 \end{array}$ --

Signed and Sealed this
Tenth Day of January 1978

[SEAL]

Attest:

RUTH C. MASON
Attesting Officer

LUTRELLE F. PARKER
Acting Commissioner of Patents and Trademarks